US006814023B1

(12) United States Patent
Foster

(10) Patent No.: US 6,814,023 B1
(45) Date of Patent: Nov. 9, 2004

(54) VEHICLE PARKING GUIDE AND SIGNALING APPARATUS

(76) Inventor: Robin R. Foster, 20831 Lakeland Dr., St. Clair Shores, MI (US) 48081

( * ) Notice: Subject to any disclaimer, the term of this patent is extended or adjusted under 35 U.S.C. 154(b) by 0 days.

(21) Appl. No.: 10/349,455

(22) Filed: Jan. 22, 2003

(51) Int. Cl.[7] ..... B60D 13/00

(52) U.S. Cl. ..... 116/28 R; 116/35 R; 33/264; 248/133

(58) Field of Search ..... 116/28 R, 35 R; 33/264; 40/606.15, 607.1; 248/133, 138

(56) References Cited

U.S. PATENT DOCUMENTS

| | | | | |
|---|---|---|---|---|
| 1,981,188 A | * | 11/1934 | Pavitt | 116/28 R |
| 2,296,311 A | * | 9/1942 | Schneider | 116/28 R |
| 2,658,467 A | | 11/1953 | Trapani, Jr. | |
| 2,731,934 A | * | 1/1956 | Hausmann et al. | 116/28 R |
| 2,854,942 A | | 8/1958 | Ross | |
| 2,956,262 A | | 8/1960 | Bahr | |
| 3,121,416 A | | 2/1964 | Gizdich | |
| 3,219,972 A | | 11/1965 | Williams | |
| 3,493,925 A | | 2/1970 | Braneale | |
| 3,664,291 A | | 5/1972 | Fritz | |
| 3,874,322 A | | 4/1975 | Brauer | |
| 3,977,354 A | | 8/1976 | Mazurek | |
| 4,341,488 A | | 7/1982 | Ryan | |
| 4,433,636 A | | 2/1984 | Crouch | |
| 4,873,509 A | | 10/1989 | Simi | |
| 4,965,571 A | | 10/1990 | Jones | |
| 5,189,802 A | | 3/1993 | Bergfield | |
| 5,227,785 A | | 7/1993 | Gann et al. | |
| 5,231,392 A | | 7/1993 | Gust | |
| 5,500,642 A | | 3/1996 | Battle | |
| 5,507,245 A | | 4/1996 | Kennedy | |
| 5,841,368 A | | 11/1998 | Bryant | |
| 6,148,760 A | * | 11/2000 | Oi | 116/28 R |

* cited by examiner

*Primary Examiner*—Diego Gutierrez
*Assistant Examiner*—Tania C. Courson
(74) *Attorney, Agent, or Firm*—VanOphem & VanOphem P.C.

(57) ABSTRACT

A vehicle parking guide apparatus adapted to provide visual indication when a predetermined position is reached. The vehicle parking guide apparatus includes a base and a pivotable contact rod with an indicator attached thereto. The base of the vehicle parking guide is positioned on the ground at a location selected to ensure that a vehicle properly engaged with the contact rod will be longitudinally and laterally aligned. To laterally position the vehicle relative to one or more lateral reference objects, the operator aligns the cross-car center of the vehicle with the indicator. To longitudinally position the vehicle relative to one or more longitudinal reference objects, the operator advances toward the parking guide until the vehicle engages the contact rod thereby causing the indicator to move. The movement of the indicator provides the operator with a visual indication that the vehicle is properly positioned in the longitudinal direction.

13 Claims, 2 Drawing Sheets

FIG - 1
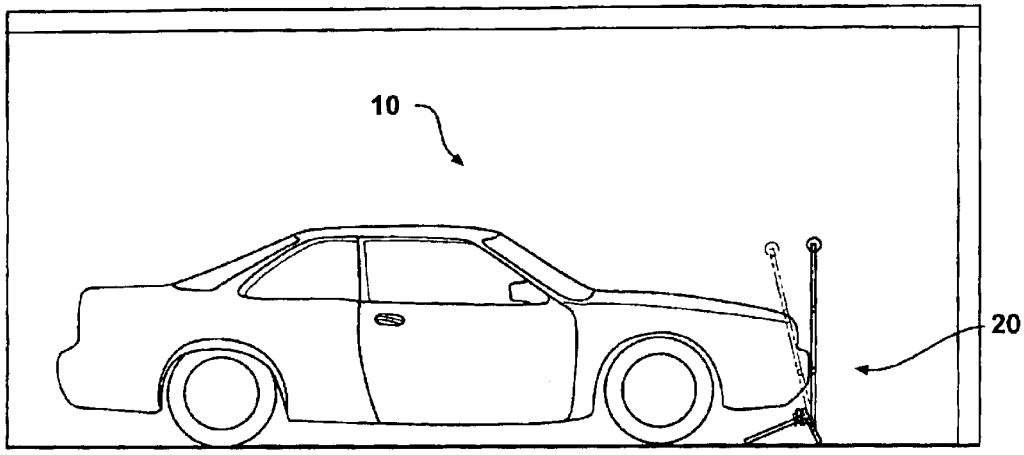
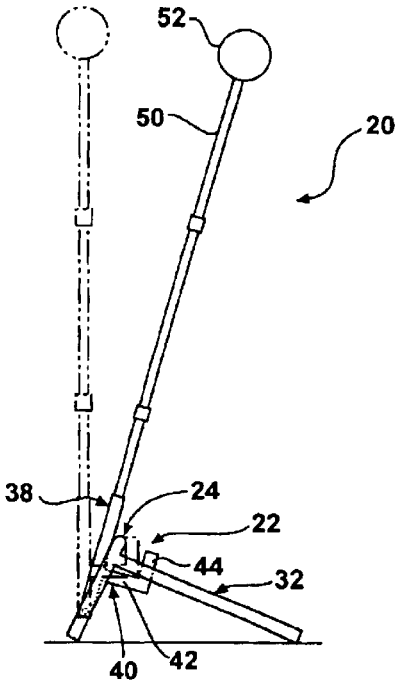
FIG - 2
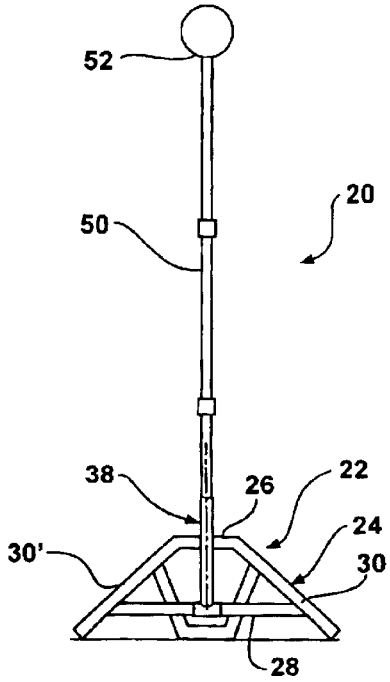
FIG - 3

VEHICLE PARKING GUIDE AND SIGNALING APPARATUS

COSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The present invention generally relates to a vehicle parking guide apparatus adapted to provide the operator of a vehicle with a visual indication when such vehicle reaches a predetermined position. More specifically, this invention relates to an apparatus having a guidepost configured to be engaged by the vehicle being parked, and thereafter pivot about a fixed base to provide a visual indication that the vehicle has reached the predetermined position.

2. Description of the Related Art

It is well known in the art that vehicle parking guides facilitate efficient utilization of an available space to accommodate the maximum number of vehicles therein and/or to optimize the remaining area such that it can be used for other purposes. Additionally, parking guides are known to reduce the risk of damage to a vehicle by indicating when a desired position has been reached such that the operator is less likely go beyond the desired position and accidentally come into contact with walls, other vehicles, etc.

The prior art has suggested various devices for assisting an operator who is parking a vehicle. For example, Ross, U.S. Pat. No. 2,854,942 and Brauer, U.S. Pat. No. 3,874,322 disclose a ball suspended from the garage ceiling with a string. The effective length of the string is adjustable such that the ball extends to a position adapted to be engaged by the windshield of a specific vehicle. The ball is further located such that when contacted by the windshield, the operator knows the vehicle is properly positioned in the garage.

Although the devices disclosed in Ross and Brauer are simple in structure, they do not provide a clear visual signal to the driver. As the vehicles head lights extend beyond the ball and therefore do not necessarily provide illumination therefor, it may be difficult to identify initial engagement of the ball. Furthermore, the Ross and Brauer disclosures do not provide a degree of proximity indication in order that the driver may choose to place the vehicle at a selected safe distance from the wall. Finally, the Ross and Brauer devices are not portable or adjustable such that a single device cannot accommodate multiple enclosures or multiple locations within a single enclosure.

Another approach for providing a parking guide apparatus generally involves an electronic signaling device and an actuation switch therefor. An example of this approach is disclosed by Brancale, U.S. Pat. No. 3,493,925, which teaches a magnetic proximity switch mounted on the rear wall of a garage. The magnetic attraction between the proximity switch and an approaching vehicle causes a contact element to pivot and thereby complete a circuit such that a lamp bulb is illuminated. The illumination of the lamp bulb indicates that sufficient forward progress has been made into the garage and that proper positioning of the vehicle can be effected by backing up until the light is extinguished.

The lamp bulb taught by Brancale provides a clear and unambiguous visual signal to the driver, and in that respect represents an improvement over the teachings of Ross and Brauer. Brancale, however, suffers from problems attributable to its excessive complexity. The complicated mechanism of operation and corresponding numerous parts drive-up production cost and give rise to additional failure modes such that the apparatus becomes unnecessarily expensive and prone to failure. Additionally, a malfunction of the Brancale electronic device is not necessarily readily apparent and potentially gives rise to a false sense of security. If the electronic device malfunctions, the operator may continue advancing the vehicle well beyond the point of engagement with the lever while expecting the lamp bulb to eventually become illuminated. In fact, a malfunctioning parking guide device providing a false sense of security is frequently worse than having no parking device whatsoever. Furthermore, Brancale and other similar devices do not provide for both longitudinal and lateral positioning of a vehicle, and are not configured to indicate the degree of proximity to a wall. Finally, the Brancale parking device consumes a large section of wall space which is particularly significant in the context of a private garage wherein available space is frequently a premium.

Ryan, U.S. Pat. No. 4,341,488, discloses a guidepost device for parking vehicles. The guidepost device includes a flexible rod having one end secured to a base member, and an opposite end attached to an indicator. The base member is adhesively fixed to the floor of a garage. The flexible rod is of such a length that the indicator is positioned above the hood of the vehicle within easy view of the driver. The indicator includes a battery, a light and an electronic chip to create a flashing effect. The indicator further includes a switch adapted to activate the flashing light when the flexible rod is angularly disposed by a vehicle. When the indicator light is illuminated, the vehicle operator backs up enough to turn off the light, at which time the vehicle is correctly positioned.

Ryan discloses a much simpler device than that disclosed by Brancale, and accordingly the Ryan device is likely to be less expensive and less prone to failure. The Ryan device does, however, rely on a battery operated electric device which inherently gives rise to additional failure modes such as a discharged battery, a defective chip or a burned out light. Furthermore, a malfunction of the Ryan device is not necessarily readily apparent and potentially gives rise to a false sense of security. If the device disclosed by Ryan malfunctions, the operator may continue advancing the vehicle well beyond the point of engagement with the flexible rod while expecting the lamp bulb to eventually become illuminated. Additionally, the guidepost device is fixed to the floor in a semi-permanent manner such that it is not portable or adjustable. Accordingly, a single guidepost cannot accommodate multiple vehicles within the same enclosure, and cannot accommodate a different size vehicle in a single parking space. Finally, the Ryan disclosure does not provide a degree of proximity indication in order that the driver may choose to place the vehicle at a selected safe distance from the wall.

Kennedy, U.S. Pat. No. 5,507,245, discloses a device adapted to provide an indication of the clearance between a vehicle and a wall surface. The clearance indicating device includes a support frame mounted to a wall surface, and a contact rod member pivotally mounted to the support frame. A lower portion of the contact rod member is biased to extend outward into the path of the vehicle and is pivoted thereby. An upper portion of the contact rod member increasingly pivots away from the support frame as the vehicle approaches the wall. A pull cord has one end secured to the upper portion of the rod member and its other end is secured to one end of a sliding rod member. A tension cord mounted to the sliding rod member has one free end connected to a swing arm member that is pivotally mounted in a cantilever manner on the support frame. The swing arm member will swing outward from the support frame by an amount proportional to the distance between the vehicle and the wall.

Kennedy addresses several of the aforementioned problems associated with conventional vehicle parking guides. For example, the Kennedy device is mechanically actuated and therefore not dependent upon a power supply for operation, and is adapted to indicate the degree of proximity to a wall. Unfortunately, however, the Kennedy invention suffers from many of the problems identified with respect to the Brancale disclosure. Specifically, Kennedy is overly complex, includes a complicated mechanism of operation with numerous parts, and is therefore unnecessarily expensive and prone to failure. Additionally, a malfunction of the Kennedy device is not necessarily readily apparent, thereby giving rise to the false sense of security referred to hereinabove with respect to the Brancale and Ryan inventions. Furthermore, Kennedy does not provide for both longitudinal and lateral positioning of a vehicle. Finally, the Kennedy parking device consumes a great deal of space within the garage that would otherwise be available for alternate purposes.

From the above, it can be appreciated that vehicle parking guides of the prior art are not fully optimized. Therefore, what is needed is a simple, reliable and inexpensive device that is portable and adjustably adapted to provide both longitudinal and lateral positioning of a vehicle within an enclosure, as well as an indication of proximity to a predefined reference, whereby failure of such apparatus is readily apparent and does not provide a false sense of security.

BRIEF SUMMARY OF THE INVENTION

According to the preferred embodiment of the present invention, there is provided a vehicle parking guide adapted to provide a visual indication of the clearance between the vehicle and one or more predefined reference objects. The parking guide includes a base and a pivotable contact rod attached thereto.

The base is self-supporting and is placed at a predetermined location as will be described in detail hereinafter. As the base is not rigidly mounted to any external structural components, the vehicle parking guide is both portable and adjustable. The base includes a travel stop adapted to limit the range of motion of the pivotable contact rod attached thereto.

Due to its own weight, the contact rod tends to pivot toward the vehicle. The travel stop limits such tendency to pivot thereby establishing the steady state position of the contact rod at approximately 70 degrees from horizontal. In the opposite direction, the travel stop prevents the contact rod from rotating past vertical such that the contact rod's entire range of motion is limited to approximately 20 degrees. An upper free end of the contact rod is provided with a visible indicator. The contact rod is of such a length that the indicator is positioned above the hood of the vehicle within easy view of the driver.

The predetermined location at which the parking guide is placed is selected to ensure that a vehicle properly engaged with the contact rod will be longitudinally and laterally positioned with respect to the one or more predefined reference objects. To laterally position the vehicle relative to the one or more predefined reference objects, the operator aligns the cross-car center of the vehicle with the indicator. To longitudinally position the vehicle relative to the one or more predefined reference objects the operator advances toward the parking guide until the vehicle engages the contact rod thereby causing the indicator to move. The movement of the indicator provides the operator with a visual indication that the vehicle is properly positioned in the longitudinal direction. Optionally, the operator can continue advancing the vehicle until the contact rod is translated through its entire range of motion and engages the travel stop, thereby allowing the operator to longitudinally align the vehicle within a range of proximity to the one or more predefined reference objects.

The predetermined location for the parking guide is dependent upon the specific vehicle, the parking area, and the individual needs of the user. Accordingly, the operator can adjust the lateral and/or longitudinal position of the parking guide to accommodate different types of vehicles, accommodate multiple vehicles within a single parking area, and to optimally take advantage of the remaining space within the parking area.

It is an object of the present invention to provide a simple, reliable and inexpensive vehicle parking guide.

It is another object of the present invention to provide a vehicle parking guide that is portable.

It is still another object of the present invention to provide an adjustable vehicle parking guide adapted to accommodate different vehicles, different storage configurations within a garage, and to optimally take advantage of the remaining space within the garage.

It is yet another object of the present invention to provide an apparatus for indicating to an operator when the vehicle is in a desired lateral and longitudinal position.

It is a further object of the present invention to provide vehicle parking guide adapted to indicate proximity to a predefined reference element.

It is still a further object of the present invention to provide a vehicle parking guide wherein failure thereof is readily apparent, and such parking guide does not provide a false sense of security.

These objects and other features, aspects, and advantages of this invention will be more apparent after a reading of the following detailed description, appended claims, and accompanying drawings.

BRIEF DESCRIPTION OF THE SEVERAL VIEWS OF THE DRAWINGS

FIG. 1 is a side view of a conventional vehicle engaged with a vehicle parking guide constructed according to the preferred embodiment of the present invention;

FIG. 2 is a side view of the vehicle parking guide of FIG. 1;

FIG. 3 is a front view of the vehicle parking guide of FIG. 1;

DETAILED DESCRIPTION OF THE PREFERRED EMBODIMENT

Referring now in detail to the Figures, there is shown in FIG. 1 a vehicle parking guide 20 that is constructed according to the preferred embodiment of the present invention. A vehicle 10 is shown engaged with the vehicle parking guide 20 such that the vehicle 10 is both laterally and longitudinally positioned with respect to one or more predefined reference objects. In the context of the following detailed description of the preferred embodiment, the one or more predefined reference objects should be considered to represent the interior walls of a parking garage (not shown in detail), however, it should be appreciated that the present invention is configured to facilitate parking in any conceivable environment and therefore should not be limited to applications involving a parking garage. Additionally, reference lo terms such as front, back, top, bottom, etc. are defined relative to the vehicle 10 as viewed in FIG. 1, wherein the hood is toward the front and the trunk is toward the back.

As shown in FIGS. 2 and 3, the vehicle parking guide 20 includes a base 22 and a pivotable contact rod 50 attached thereto. The base 22 and the contact rod 50 are preferably composed of polyvinyl chloride (PVC) tubular members interconnected with conventional PVC connection members such that the vehicle parking guide 20 remains light, cost effective, and does not damage the vehicle 10. Optionally, the tubular members may be detachably connected so that the vehicle parking guide 20 is easily disassembled for convenient transportation thereof. It should be appreciated, however, that other materials and/or configurations can be envisioned and the invention disclosed herein should not be limited to the construction of the preferred embodiment.

Figure 4:
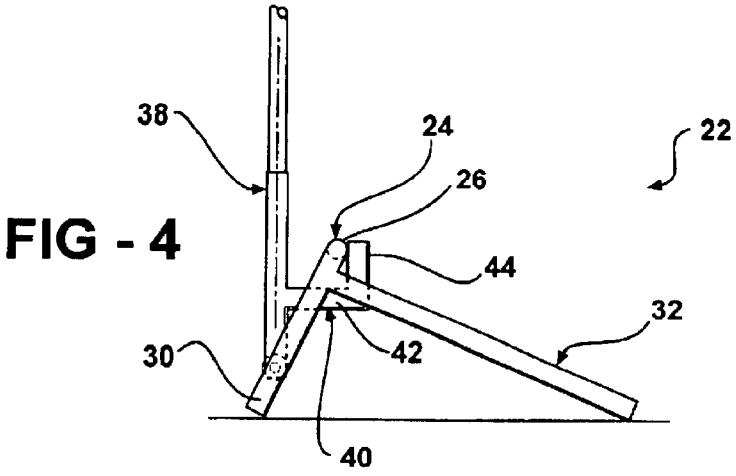
FIG. 4 is a side view of a base of the vehicle parking guide of FIG. 1.
Figure 5:
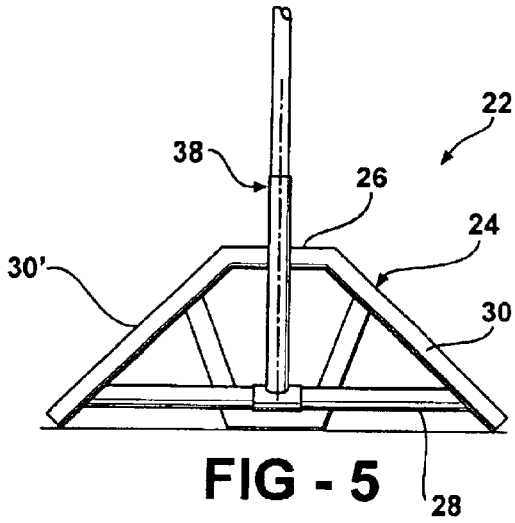
FIG. 5 is a front view of the base of FIG. 4.
Figure 6:
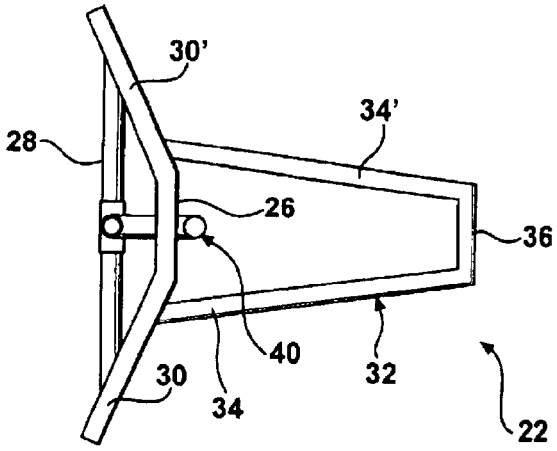
FIG. 6 is a plan view of the base of FIG. 4.

Referring to FIGS. 4–6, the base 22 of the vehicle parking guide 20 generally includes an A-frame structure 24, a support structure 32 and a pivotable attachment member 38. The A-frame structure 24 includes an upper horizontal member 26 defining the apex of the A-frame, a lower horizontal member 28 and leg members 30, 30'. The A-frame structure 24 is configured to slant at approximately 25 degrees from vertical such that the exposed ends of the leg members 30, 30' define the forward most portion of the A-frame structure 24 and the upper horizontal member 26 define the rearward most portion of the A-frame structure 24.

The support structure 32 is generally rectangular having extension members 34, 34 interconnected at one end thereof with a cross member 36 perpendicular thereto. The exposed ends of the extension members 34, 34 are connected to the leg members 30, 30 of the A-frame structure 24, at a position between the upper horizontal member 26 and the lower horizontal member 28, with conventional T-shaped PVC connection members such that the support structure 32 generally extends perpendicularly therefrom. The base 30 22 rests on the exposed ends of the leg members 30, 30 of the A-frame structure 24 and the cross member 36 of the support structure 32. The length of the extension member 34, 34 is selected as that which positions the A-frame structure 24 at approximately 25 degrees from vertical.

The attachment member 38 is preferably a linear tubular member pivotably connected to the lower horizontal member 28 of the A-frame structure 24 and extending therefrom in an upward and rearward direction. The attachment member 38 extends above the upper horizontal member 26 and is forward relative thereto such that the pivotal range of motion of the attachment member 38 is limited in a clockwise direction by the upper horizontal member 26 of the A-frame structure 24. The attachment member 38 is slanted at approximately 20 degrees from vertical when engaged with the upper horizontal member 26.

The attachment member 38 includes an end of travel stop 40. The travel stop 40 includes a leg portion 42 extending in a generally rearward direction from the attachment member 38, and a foot portion 44 extending in a generally upward direction from the leg portion 42 such that the upper horizontal member 26 of the A-frame structure 24 is trapped between the foot portion 44 of the travel stop 40 and the attachment member 38. Accordingly, the travel stop 40 is adapted to limit the pivotal range of motion of the attachment member 38 in a counterclockwise direction by engaging the foot portion 44 of the travel stop 40 with the upper horizontal member 26 of the A-frame structure 32. Referring again to FIG. 2, the travel stop 40 is preferably configured to prevent the attachment member 38 from pivoting in a counterclockwise direction beyond the vertical broken line position thereof, whereby the entire range of motion of the attachment member 38 is limited to approximately 20 degrees.

As shown in FIGS. 2 and 4, the uppermost end of the attachment member 38 is adapted to accommodate the contact rod 50 in a detachable manner for convenient transportation of the vehicle parking guide 20. The uppermost end of the contact rod 50 is adapted to accommodate an indicator 52, which is preferably brightly colored and therefore highly visible. According to the preferred embodiment of the present invention, the indicator 52 is intended to be customizable. In one example, the indicator 52 is composed of a plurality of brightly colored synthetic fibers extending outwardly from a core to form a sphere. Any number of other compositions and/or configurations can, however, be envisioned for the indicator 52 such as brightly colored synthetic flowers, a name plate, or a reflector element intended to reflect the headlights of the vehicle 10 and thereby enhance visibility.

The contact rod 50 extends along the axis of the attachment member 38 in a generally upward and slightly rearward direction, and is preferably composed of detachably interconnected linear tubular members. The detachable construction of the contact rod 50 is advantageous for purposes of transportation and adjustment. The contact rod 50 is more compact and thus easier to transport as several smaller tubular members than as one long element. Additionally, the overall length of the contact rod 50 can be adjusted by varying the total number and/or individual lengths of the composite tubular members. This adjustment is significant in that, while the contact rod 50 must be at least long enough to position the indicator 52 above the hood of the vehicle 10, the maximum length of the contact rod 50 is defined by that which is most clearly visible to the driver. Accordingly, the length of the contact rod 50 can be customized to optimally suit the needs of a particular user and may be adjusted such that a single vehicle parking guide 20 can accommodate multiple users.

Due to its own weight, the contact rod 50 is pivotally biased in a clockwise direction toward the vehicle such that the attachment member 38 is engaged with the upper horizontal member 26 of the A-frame structure 24. As the travel stop 40 prevents the attachment member 38 and the contact rod 50 attached thereto from pivoting in a counter clockwise direction beyond vertical, the vehicle parking guide 20 is generally contained within the fore/aft and cross-car portion of the garage already allocated for storage of the vehicle. In other words, the limited range of motion restricts the contact rod 50 from extending in a forward direction substantially beyond the front of the vehicle such that the vehicle parking guide 20 takes up very little room. Therefore, the vehicle parking guide 20 can be used in applications with limited available space, and allows a user to optimally allocate any excess space for other purposes.

The vehicle parking guide 20 is self-supporting and does not require rigid attachment to any external structural components such that the vehicle parking guide 20 is adjustable and transportable. The self-supporting configuration, particularly in combination with the preferred detachable construction, render each vehicle parking guide 20 suitable for use at multiple locations. A single vehicle parking guide 20 can be broken down after it is used and conveniently stored in a vehicle such that the operator thereof can re-assemble and set up the vehicle parking guide 20 wherever it becomes necessary to park. For example, the vehicle parking guide 20 can be quickly set up to prevent damage when parking in close proximity to other vehicles, in commercial parking garages, or near a concrete parking block commonly found at public parking areas.

The vehicle parking guide 20 is positioned on the floor of the garage at a location selected to ensure that a vehicle properly engaged with the contact rod 50 will be longitudinally and laterally aligned relative to the interior walls of the garage. In other words, a user selects a desired parking position for the vehicle 10 and positions the vehicle parking guide 20 such that the vehicle 10 will properly engage the contact rod 50 when the vehicle 10 is at the desired parking position. As indicated in the preceding paragraph, the vehicle parking guide 20 is self-supporting such that the position thereof is adjustable. Accordingly, multiple reference positions for the vehicle parking guide 20 may be established to facilitate parking in different garages, parking multiple vehicles within a single garage, parking a variety of different vehicles in a single parking area, etc.

To laterally position the vehicle 10 relative to one or more lateral reference objects, which for purposes of the present discussion are the lateral garage walls, the operator aligns the cross-car center of the vehicle 10 with the indicator 52. To longitudinally position the vehicle relative to one or more longitudinal reference objects, i.e. the front wall of the garage, the operator advances toward the vehicle parking guide 20 until the vehicle 10 engages the contact rod 50 thereby causing the indicator 52 to move. The movement of the indicator 52 provides the operator with a visual indication that the vehicle 10 is properly positioned in the longitudinal direction. Optionally, the operator can continue advancing the vehicle 10 until the contact rod 50 is translated through its entire range of motion, thereby allowing the operator to longitudinally align the vehicle 10 within a range of proximity to the one or more longitudinal reference objects.

While the present invention has been described in terms of a preferred embodiment, it is apparent that other forms could be adopted by one skilled in the art. The teachings of the present invention are intended to encompass any reasonable substitutions or equivalents of claim limitations. Those skilled in the art will appreciate that other applications, including those outside of the automotive industry, are possible with this invention. Accordingly, the scope of the present invention is to be limited only by the following claims.

What is claimed is:

1. A portable vehicle parking guide adapted to rest on the floor of a parking facility and to position a vehicle at a predetermined location relative to a lateral reference object and a longitudinal reference object, said vehicle parking guide comprising:

a base member mounted on said floor of said parking facility, said base member further adapted to support said vehicle parking guide apparatus, and adjustably positioned relative to said lateral reference object and said longitudinal reference object, said base member further comprising:

at least two leg support members positioned in spaced apart relationship;

an upper frame member having one end attached to one of said at least two leg support members and an opposite end attached to the other of said at least two leg support members; and a lower frame member having one end attached to one of said at least two leg support members and an opposite end attached to the other of said at least two leg support members;

a contact rod having a first end pivotably attached to said lower frame member and a second end opposite said first end extending in a direction away from said base member, said first end of said contact rod further having a first extension leg portion attached to said first end of said contact rod, said first extension leg portion extending transverse to said lower frame member; and a second extension foot member attached to said first extension leg portion, said second extension foot portion extending in a direction toward said upper frame member and adapted to communicate with said upper frame member as said contact rod is pivoted from a first position to a second position;

said second end extending a predetermined distance above the hood of said vehicle so as to be clearly visible by the driver of said vehicle; and a visual indicator attached to said second end of said contact rod;

whereby when a vehicle engages said contact rod said vehicle parking guide provides a visible indication to an operator of said vehicle by pivoting a predetermined distance such that said operator of said vehicle can visually determine when said vehicle is at said predetermined location.

2. The vehicle parking guide according to claim 1, wherein said base and said contact rod are composed of a plurality of detachably interconnected members such that said vehicle parking guide is easily disassembled for convenient transportation thereof.

3. The vehicle parking guide according to claim 1, wherein said contact rod is composed of plastic such that said contact rod is light weight and unlikely to damage said vehicle.

4. The vehicle parking guide according to claim 1, wherein said adjustable position of said base relative to said longitudinal reference object is established such that said pivotably attached contact rod defines a range of longitudinal positions for said vehicle.

5. The vehicle parking guide according to claim 1, wherein said indicator is customizable to best suit the needs of each customer.

6. The vehicle parking guide according to claim 1, wherein said vehicle parking guide is compact such that said vehicle parking guide is adapted to utilize the lateral and longitudinal space within an enclosure that is necessarily allocated for said vehicle.

7. The vehicle parking guide according to claim 1, wherein said vehicle parking guide is compact such that said vehicle parking guide is adapted to utilize the lateral and longitudinal space within an enclosure that is necessarily allocated for said vehicle.

8. A method for positioning a vehicle within a predetermined range of locations defined relative to a lateral reference object and a longitudinal reference object, said method comprising the steps of:

providing a base member mounted on a floor of a parking structure, said base member comprising at least two leg support members positioned in spaced apart relationship; an upper frame member having one end attached to one of said at least two leg support members and an opposite end attached to the other of said at least two leg support members; and a lower frame member having one end attached to one of said at least two leg support members and an opposite end attached to the other of said at least two leg support members;

pivotally attaching one end of a contact rod to said lower frame member of said base member such that one end of a leg and foot extension of said contact rod communicates with said upper frame member of said base to limit pivotal movement of said contact rod;

attaching a visual indicator to the opposite end of said contact rod such that said visual indicator is located above the hood of said vehicle and clearly visible to the driver thereof;

adjustably positioning said base member relative to said lateral reference object and said longitudinal reference object;

aligning said vehicle with said one end of said contact rod such that the cross car center position of said vehicle is laterally aligned with said one end of said contact rod; and advancing said vehicle into engagement with said one end of said contact rod such that a visual indication of contact therebetween is provided by said visual indicator.

9. The method according to claim 8, wherein said step of providing said base member further comprises the step of providing said base member composed of a plurality of detachably interconnected members such that said base member is easily disassembled for convenient transportation thereof.

10. The method according to claim 9, wherein said step of providing said contact rod further comprises the step of providing said contact rod composed of a plurality of detachably interconnected members such that said contact rod is easily disassembled for convenient transportation thereof.

11. The vehicle parking guide according to claim 8, wherein said step of providing said base member further comprises the step of providing said base member composed of plastic such that said base member is light weight and unlikely to damage said vehicle.

12. The method according to claim 11, wherein said step of providing a contact rod further comprises the step of providing a contact rod composed of a plurality of detachably interconnected members such that said contact rod is easily disassembled for convenient transportation thereof.

13. The method according to claim 8, wherein said step of providing said contact rod further comprises the step of providing said contact rod a plurality of detachably interconnected members such that said contact rod is easily disassembled for convenient transportation thereof.

* * * * *

UNITED STATES PATENT AND TRADEMARK OFFICE

CERTIFICATE OF CORRECTION

PATENT NO. : 6,814,023 B1
DATED : November 9, 2004
INVENTOR(S) : Robin R. Foster It is certified that error appears in the above-identified patent and that said Letters Patent is hereby corrected as shown below:

Column 1,
Line 5, kindly delete "COSS" and insert -- CROSS --.

Column 5,
Line 20, kindly delete "lo" and insert -- to --.
Lines 50, 52 and 60, kindly delete the second occurrence of "34" and insert -- 34' --.
Lines 53 and 58, kindly delete the second occurrence of "30" and insert -- 30' --.
Line 57, kindly delete "30".

Column 6,
Line 18, kindly delete "32" and insert -- 24 --.

Signed and Sealed this

First Day of March, 2005

JON W. DUDAS
*Director of the United States Patent and Trademark Office*